US005615245A

United States Patent [19]

Hashimoto

[11] Patent Number: 5,615,245

[45] Date of Patent: Mar. 25, 1997

[54] MONOCHROMATOR FOR RADIANT X-RAYS

[75] Inventor: Shinya Hashimoto, Ibaraki-ken, Japan

[73] Assignee: Japan Atomic Energy Research Institute, Tokyo, Japan

[21] Appl. No.: 607,333

[22] Filed: Feb. 26, 1996

[30] Foreign Application Priority Data

Feb. 27, 1995 [JP] Japan ..... 7-038553

[51] Int. Cl.[6] ..... G21K 1/06

[52] U.S. Cl. ..... 378/84; 378/85; 359/845; 359/859

[58] Field of Search ..... 378/84, 85, 145; 359/845, 859

[56] References Cited

U.S. PATENT DOCUMENTS 5,004,319 4/1991 Smither ..... 378/84
5,287,395 2/1994 Khounsary ..... 378/85
5,485,497 1/1996 Oizumi et al. ..... 378/84

*Primary Examiner*—Don Wong
*Attorney, Agent, or Firm*—Tarolli, Sundheim, Covell, Tummino & Szabo

[57] ABSTRACT

A monochromator for radiant X-rays is composed of a first crystal which has a first surface of incidence having a concave letter V-shaped groove and cooling means for flowing a cooling material behind the first surface of incidence along the letter V-shaped groove, and a second crystal which has a second surface of incidence having a letter V-shaped convex. A parallel pencil of X-rays which impinges on the first surface of incidence elongates to a half-ellipse on the first surface of incidence and reflects in parallel therefrom to the second surface of incidence. Then, a pencil of emissive X-rays having the same size as the initial parallel pencil of X-rays exits the second surface of incidence to become useful light. The monochromator for radiant X-rays which has a high cooling efficiency, is easy to adjust, provides a pencil of emissive X-rays stably and highly accurately. The monochromator is easy to use and economical, and allows easy maintenance.

8 Claims, 11 Drawing Sheets

MONOCHROMATOR FOR RADIANT X-RAYS

BACKGROUND OF THE INVENTION

1. Field of the Invention

The present invention relates to a spectroscope which is installed in an X-ray beam line using an undulator as a light source in high luminance radiant beam facilities for synchrotron, and particularly to a monochromator for radiant X-rays which is used as part of apparatus for X-ray analysis of structure and material evaluation.

2. Prior Art

According to a conventional monochromator, as shown in FIG. 14, one surface of a plate-like monochromator or a plate crystal serves as a reflecting surface, and another surface serves as a cooling surface. The reflecting surface is heated, and the cooling surface is cooled by a cooling material or a coolant such as water or liquid metal. In a certain type of monochromator, the cooling surface is finned or processed likewise so as to increase a cooling efficiency. However, in such plate type monochromators, heat applied to the reflecting surface causes stress deformation, and thus the surface of a crystal thermally deforms with a resultant problem of the scattering of emissive X-rays.

FIG. 1 shows typical thermal deformations of a monochromator crystal. As shown in FIG. 1(*a*), when the entire surface of the plate crystal is irradiated with incident X-rays and thus heated uniformly and also when the other surface is cooled, only a grating constant expands uniformly, while planes of atoms remain uninclined. Thus, a uniform expansion (lattice expansion) occurs in which an expansion reduces as it goes downward. In this case, a warp (bowing) (FIG. 1(*c*)) occurs with the heated surface being convexed. If a local zone is irradiated, only the irradiated portion swells like a knot or a bump (FIG. 1(*b*)). These thermal deformations of a plate crystal cause a pencil of emissive X-rays to diverge as represented with E' and E" when the surface of a crystal is irradiated with a parallel pencil of incident X-rays. That is, X-rays are reflected in nonparallel, causing a marked deterioration in spectroscopic performance (energy resolution and intensity) of X-rays.

Particularly, in designing a beam line in high-luminance radiant beam facilities most of which are occupied by an insertion light source, the aforesaid thermal deformation of a crystal is a most serious problem. Various devices have been adopted, but most of them are intended to physically improve a cooling capability. A monochromator with practical specifications has not been obtained yet. Too much emphasis is rather placed on an improvement of cooling capability, leading to a problem of instability at a lower accuracy, difficulty in use, higher costs, complicated maintenance and the like.

FIG. 2 shows an inclined crystal monochromator which has been developed for use with APS, U.S.A. (Advanced Photon Source, U.S.A.; energy 7.0 GeV; characteristic photon energy 19.0 KeV; 34 beam lines +α; circumferential length 1104 m). An angle between incident X-rays and lattice planes can never be changed, but the surface of a crystal can have an arbitrary angle. As shown in FIG. 2, (111) lattice planes (crystallographic planes related to spectroscopy) of a single crystal of silicon are laid horizontally, and the single crystal is cut at an angle of near 90 degrees from crystallographic planes to obtain an inclined surface. When X-rays impinge on the inclined surface, their shadow is cast long thereon, and thus a heat flux per unit area becomes smaller, whereby generated heat can be reduced. This means that the shadow should be cast long so as to reduce generated heat, denoting a need for a large crystal. FIG. 3 shows measurements of a ratio of an irradiated area on the surface of a crystal to the orthogonal cross-sectional area of a beam as an angle of inclination of a crystal from incident X-rays is varied. As seen from FIG. 3, as the angle of inclination increases, the ratio increases. That is, as the angle of inclination of a crystal from a pencil of incident X-rays increases, an area of shadow of incident X-rays expands on the surface of a crystal, whereby a heat flux per unit area reduces. Also, in this geometry, a direction of thermal deformation mostly falls on crystallographic planes of a crystal, thereby producing an advantage that lattice planes related to diffraction are free from large distortion. However, in spite of these advantages, the inclined crystal monochromator is said to have the following disadvantages: (1) a large crystal needs to be used so as to reduce generated heat; (2) adjustment is difficult to make (an adjustment error is greatly amplified); and (3) a fluctuation in the position of an incident beam causes instability of the position of an emissive beam. Thus, problems with respect to practical use remain to be solved.

SUMMARY OF THE INVENTION

An object of the present invention is to provide a monochromator for radiant X-rays which minimizes a thermal deformation of a crystal, thereby overcoming the aforesaid difficulties involved in conventional apparatus; it also solves the problems with respect to practical use.

Specifically, an object of the present invention is to provide a monochromator for radiant X-rays which uses a small crystal and minimizes thermal deformation of the crystal by increasing the cooling capability, allows easy adjustment, suppresses a fluctuation in the position of a pencil of incident X-rays, provides a stable pencil of emissive X-rays, i.e., useful light at high accuracy, is easy to use and economical, and allows easy maintenance.

In accordance with the present invention, X-rays which are emitted from an X-ray source and enter a first crystal are called incident X-rays (or incident beam), X-rays which reflect from the first crystal and enter a second crystal are called reflected X-rays (or reflected beam), and X-rays (monochromatic X-rays) which exit the second crystal are called emissive X-rays (or emissive beam).

A monochromator for radiant X-rays of the present invention is characterized by comprising a first crystal which has a surface of incidence having a shape of a concave letter V-shaped groove and cooling means for flowing a cooling material behind the surface of incidence along the letter V-shaped groove, and a second crystal which has a letter V-shaped convex having a convex letter V-shape to fit the concave letter V-shaped groove.

The bottom portion of the concave letter V-shaped groove of the first crystal, i.e., a most acute-angled portion is largest in terms of the volume of a pencil of incident X-rays. As a result, the center of heat generation (i.e., the portion which receives the most intense heat, or an intensely heated zone) is formed at the bottom portion. In the first crystal, inclined surfaces of the letter V-shaped groove surround the periphery of the center of heat generation, and thus a lattice distortion due to a thermal deformation can be suppressed by the peripheral volume of the crystal.

A pencil of radiant X-rays which has impinged on the concave letter V-shaped groove of the first crystal reflects therefrom, and thus reflected X-rays impinge on the letter V-shaped convex of the second crystal. The reflected X-rays are rearranged on the second crystal to the same size as that of a pencil of incident X-rays. Thus rearranged X-rays exit the second crystal as a pencil of emissive X-rays. Accordingly, to accurately obtain a pencil of emissive X-rays, it is preferable that the first and second crystals be set within a slight range of error. Specifically, it is most preferable that the bottom portion of the concave letter V-shaped groove of the first crystal and the letter V-shaped convex of the second crystal align with each other along a centerline. However, a deviation of 0.01 mm or less is acceptable between them.

The aforesaid cooling means is provided behind the surface of incidence along the letter V-shaped groove so as to promote thermal diffusion within the first crystal. Preferably, the cooling means is provided behind the surface of incidence along the letter V-shaped groove with a starting point thereof located just under the center of heat generation. More preferably, a transport pipe is directed toward the intensely heated zone from the bottom portion of the fist crystal, branches off in opposite directions with a starting point thereof located just under the center of heat generation, and allows the cooling material to flow behind the surface of incidence along the letter V-shaped groove.

Stainless steel or Teflon (registered trademark of Dupont) is preferably used as material for the transport pipe in view of heat resistance and pressure resistance and so as to use as the cooling material water and/or liquid metal such as liquid gallium or the like having high cooling efficiency.

The operations of the above-mentioned structure will be described below.

(1) As X-rays impinge on an inclined surface of a letter V-shaped groove, the shade of X-rays can elongate on a surface of incidence, whereby a heat flux can be made smaller.

(2) Unlike conventional inclined crystal monochromators having one inclined surface, two inclined surfaces which form a letter V-shape are provided, whereby a size in a longitudinal direction can be reduced (half the size of conventional inclined crystal monochromators).

(3) A heat flux is intensest at the bottom portion of a letter V-shaped groove to form the center of heat generation. However, heat generated at the center of heat generation diffuses radially along the peripheral inclined surfaces of the letter V-shaped groove and toward the inside of a crystal underneath the groove, whereby the diffusion of heat is promoted within the crystal.

(4) Since a crystal surrounds the center of heat generation, generated thermal stresses cancel each other, whereby a distortion of the crystal due to heat (thermal deformation) can be suppressed.

(5) Cooling means is provided behind a surface of incidence along the letter V-shaped groove, whereby heat whose generation is caused by incident X-rays can be cooled efficiently.

(6) When cooling means is in the form of a transport pipe formed of stainless steel or Teflon, as cooling material water and/or liquid metal such as liquid gallium or the like can be used intact.

(7) By adopting the letter V-shaped groove which allows generated stresses to cancel each other out, a water jet which otherwise is likely to cause a local deformation of a crystal can be used as cooling means.

BRIEF DESCRIPTION OF THE DRAWINGS

The foregoing and other objects and features of the present invention will become more apparent to one skilled in the art upon a consideration of the following description taken in connection with the accompanying drawings, wherein.

DETAILED DESCRIPTION OF THE PREFERRED EMBODIMENTS

An embodiment of the present invention will now be described in detail with reference to accompanying drawings. The present invention, however, is not to be limited to the details given herein.

Figure 1:
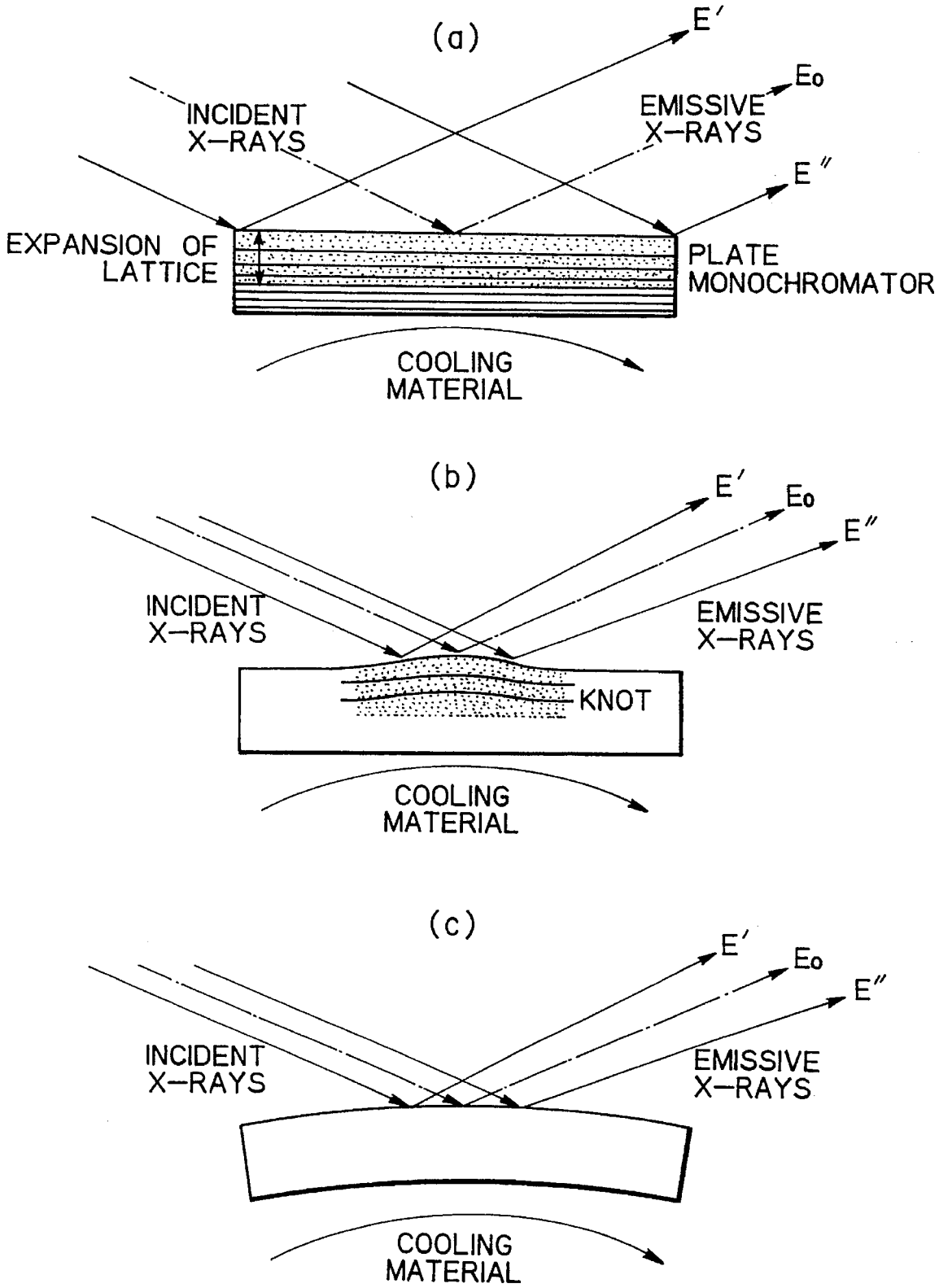
FIGS. 1(*a*)–1(*c*) are diagrams of principle illustrating a thermal deformation observed in a conventional plate type monochromator.
Figure 2:
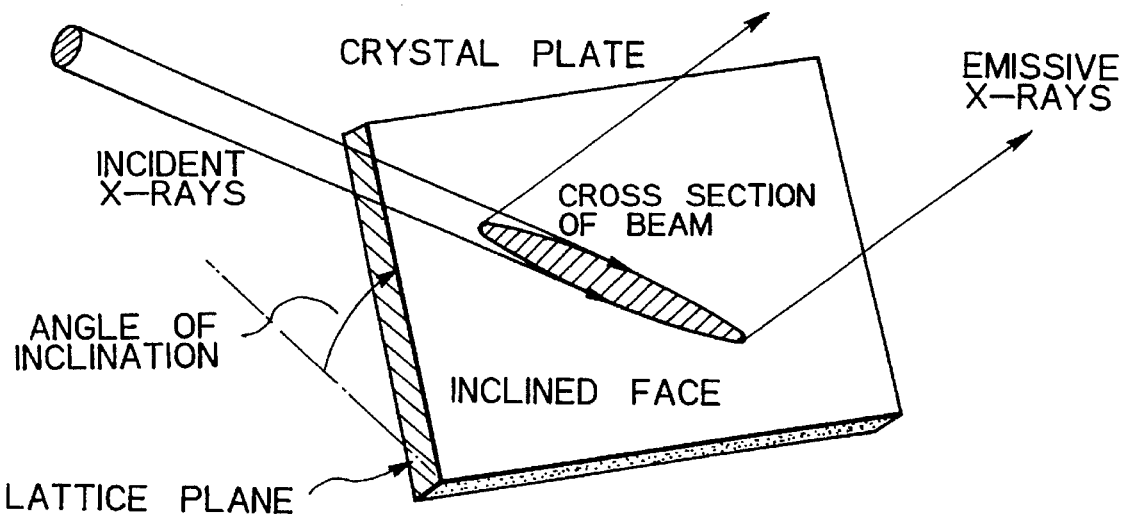
FIG. 2 is a diagram of principle showing an inclined crystal monochromator developed for use with APS, U.S.A.
Figure 3:
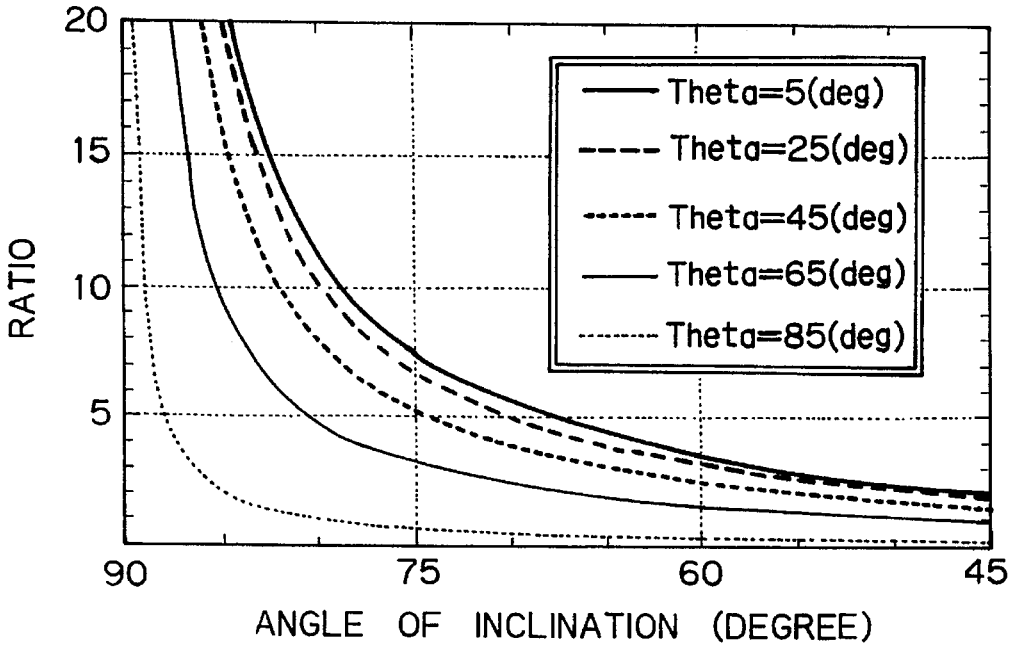
FIG. 3 is a graph showing an incident angle between crystallographic planes and a pencil of incident X-rays against an irradiated area on the surface of a crystal/orthogonal cross section of a pencil of X-rays at various angles of diffraction.
Figure 4:
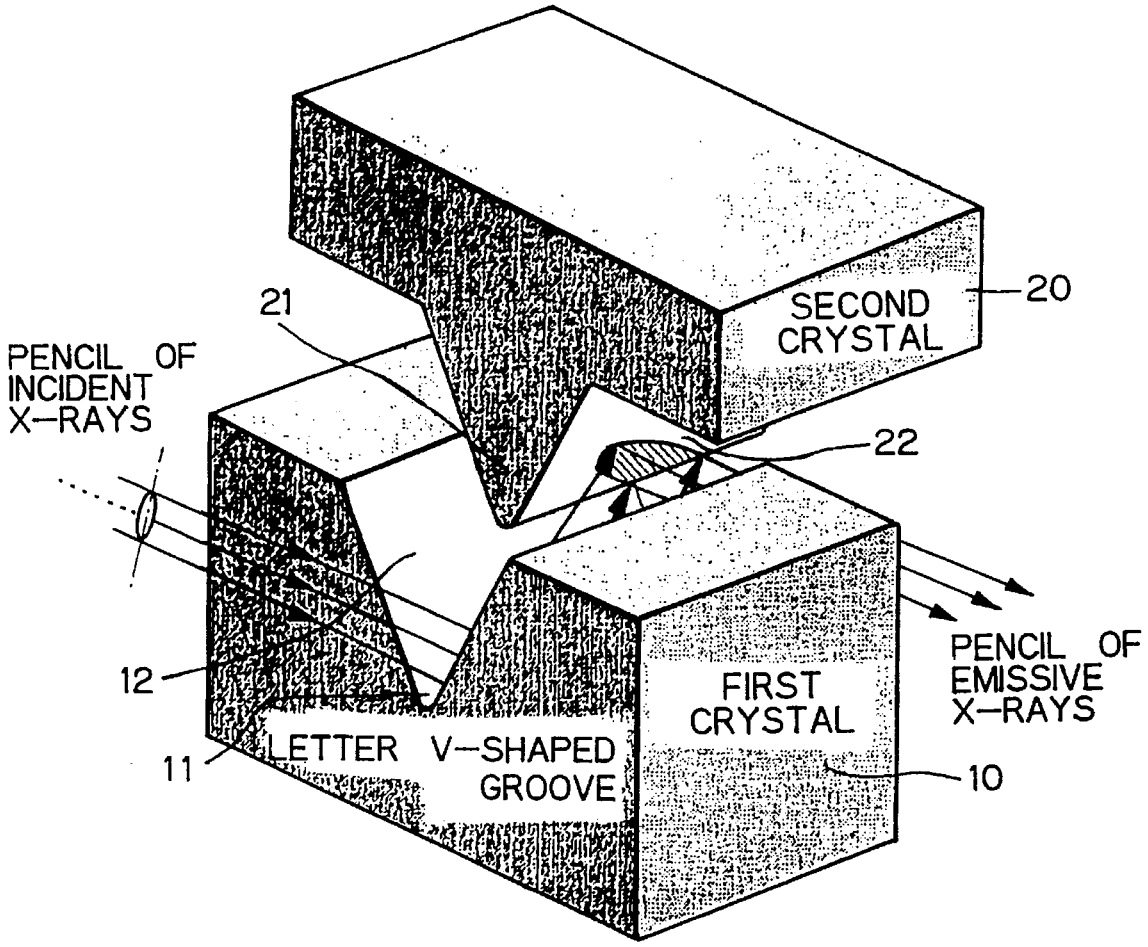
FIG. 4 is a perspective view showing an embodiment of a monochromator for radiant X-rays of the present invention.
Figure 5:
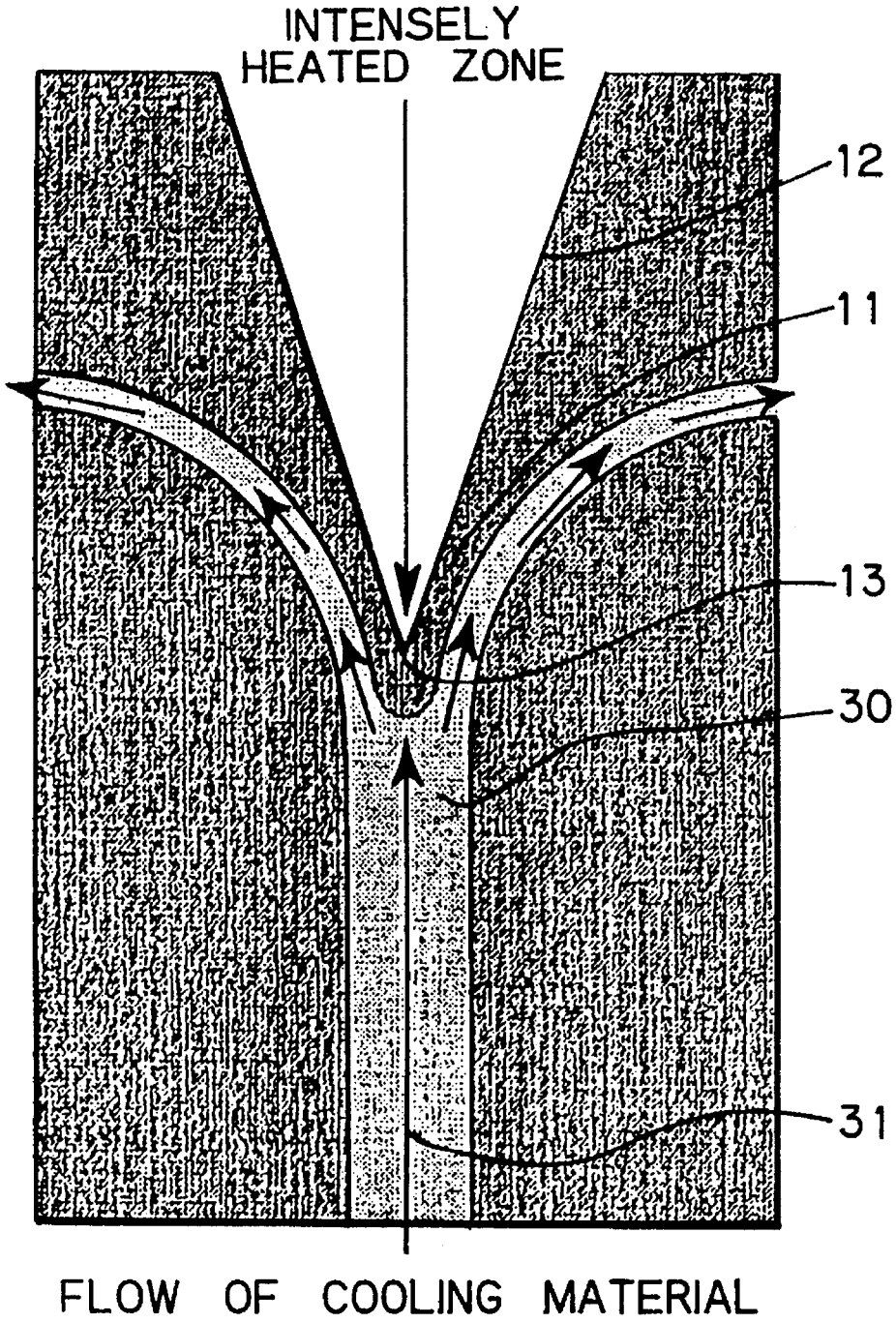
FIG. 5 is s cross-sectional view showing an embodiment of cooling means of the monochromator for radiant X-rays of the present invention.

FIG. 4 shows a monochromator for radiant X-rays according to an embodiment of the present invention. The monochromator is composed of a first crystal 10 which has a first surface of incidence 12 having a concave letter V-shaped groove 11 and a second crystal 20 which has a second surface of incidence 22 having a letter V-shaped convex 21. The first crystal 10, as shown in FIG. 5, internally includes a transport pipe 30 (cooling means) for flowing a cooling material 31 behind the first surface of incidence 12 along the concave letter V-shaped groove 11. The transport pipe 30 extends toward the bottom portion (intensely heated zone) 13 of the concave letter V-shaped groove 11 from the bottom portion of the first crystal 10, branches off in opposed directions just under the intensely heated zone 13 so as to run substantially along the inclined surfaces 12, which are the first surface of incidence of the letter V-shaped groove, and reaches side walls of the first crystal 10, from which the cooling material 31 is discharged outside. Stainless steel or Teflon which is heat-resistant and pressure resistant is used as material for the transport pipe 30, and water or liquid gallium having a good cooling efficiency is used as the cooling material 31, and also the cooling material 31 is applied to the intensely heated zone 13 in the form of a water jet.

Figure 6:
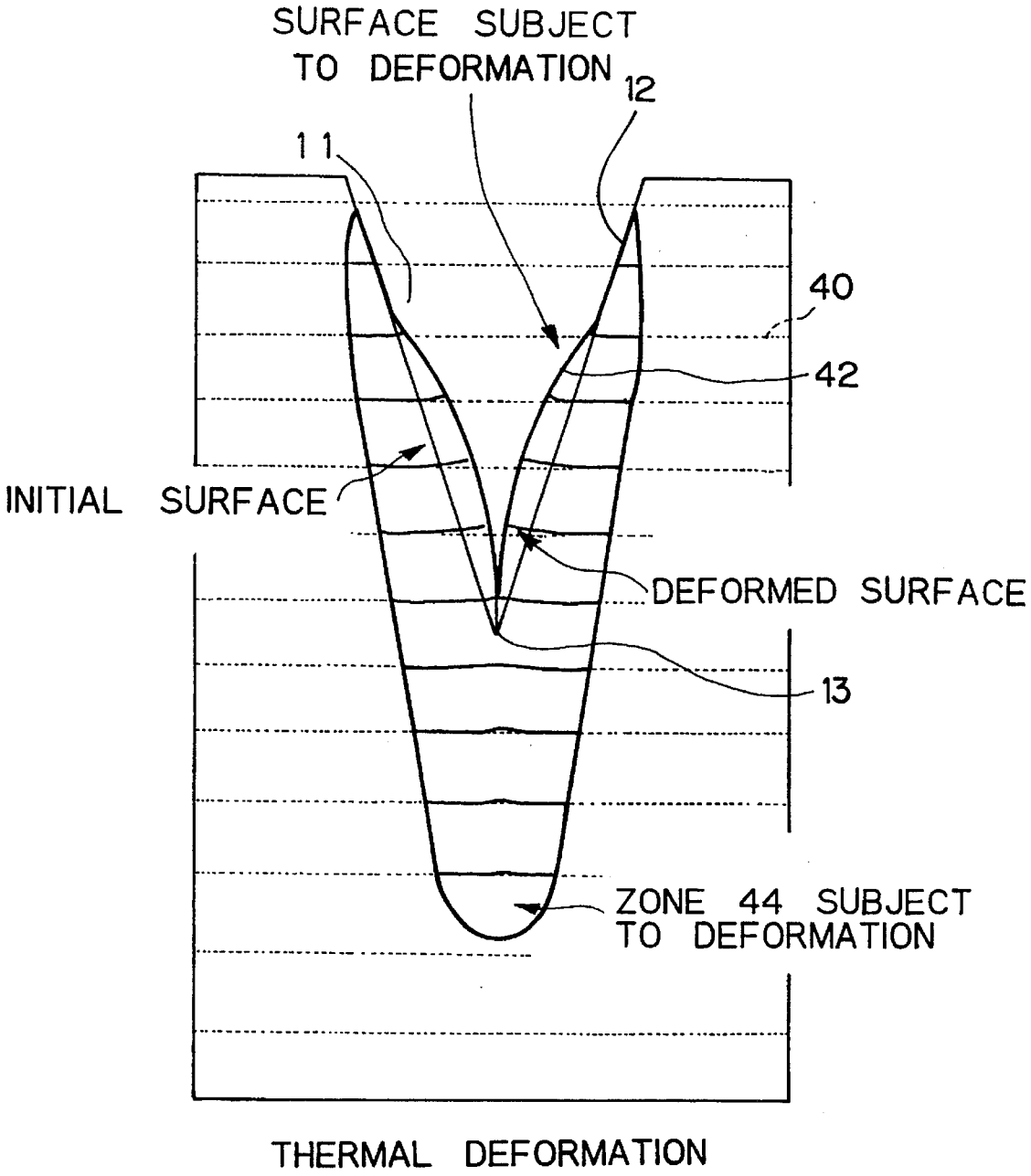
FIG. 6 is a cross-sectional view showing a lattice distortion in the monochromator for radiant X-rays of the present invention.

FIG. 6 is a schematic showing a lattice distortion of the first crystal 10 caused by heat when a pencil of radiant X-rays enters the monochromator for radiant X-rays of the present invention. In FIG. 6, horizontal lines 40 denote lattice planes. Initial lattice planes before entry of a pencil of X-rays are represented with dotted lines, and thermally deformed lattice planes are represented with solid lines. As seen from FIG. 6, a portion (denoted by 42) of the inclined surface 12 near the intensely heated zone 13 expands in an inward direction of the concave letter V-shaped groove 11, but a deformation of lattice planes themselves is slight. That is, lattice planes deform in such a manner that ends thereof slightly rise with resect to a virtual line extended from the bottom portion 13 of the concave letter V-shaped groove 11. However, thus deformed lattice planes do not deviate too much from initial lattice planes. Also, in the intensely heated zone 13, since the inclined surfaces of the concave letter V shaped groove 11 converge, thermally generated stresses cancel out each other and are attenuated, whereby thermal distortion is suppressed. In a zone 44 subject to a deformation which is directed toward the inside of the first crystal 11 underneath the intensely heated zone 13, the deformation terminates within the crystal without reaching the bottom portion and side surfaces of the crystal. Accordingly, the influence of the thermal deformation concentrates on the periphery of the intensely heated zone 13, and the influence on the entire crystal can be minimized. Thus, the influence of thermal deformation on lattice planes is very small which is observed with the monochromator for radiant X-rays of the present invention, and hence any large warp of lattice planes does not take place which is observed with conventional plate type monochromators.

Figure 7:
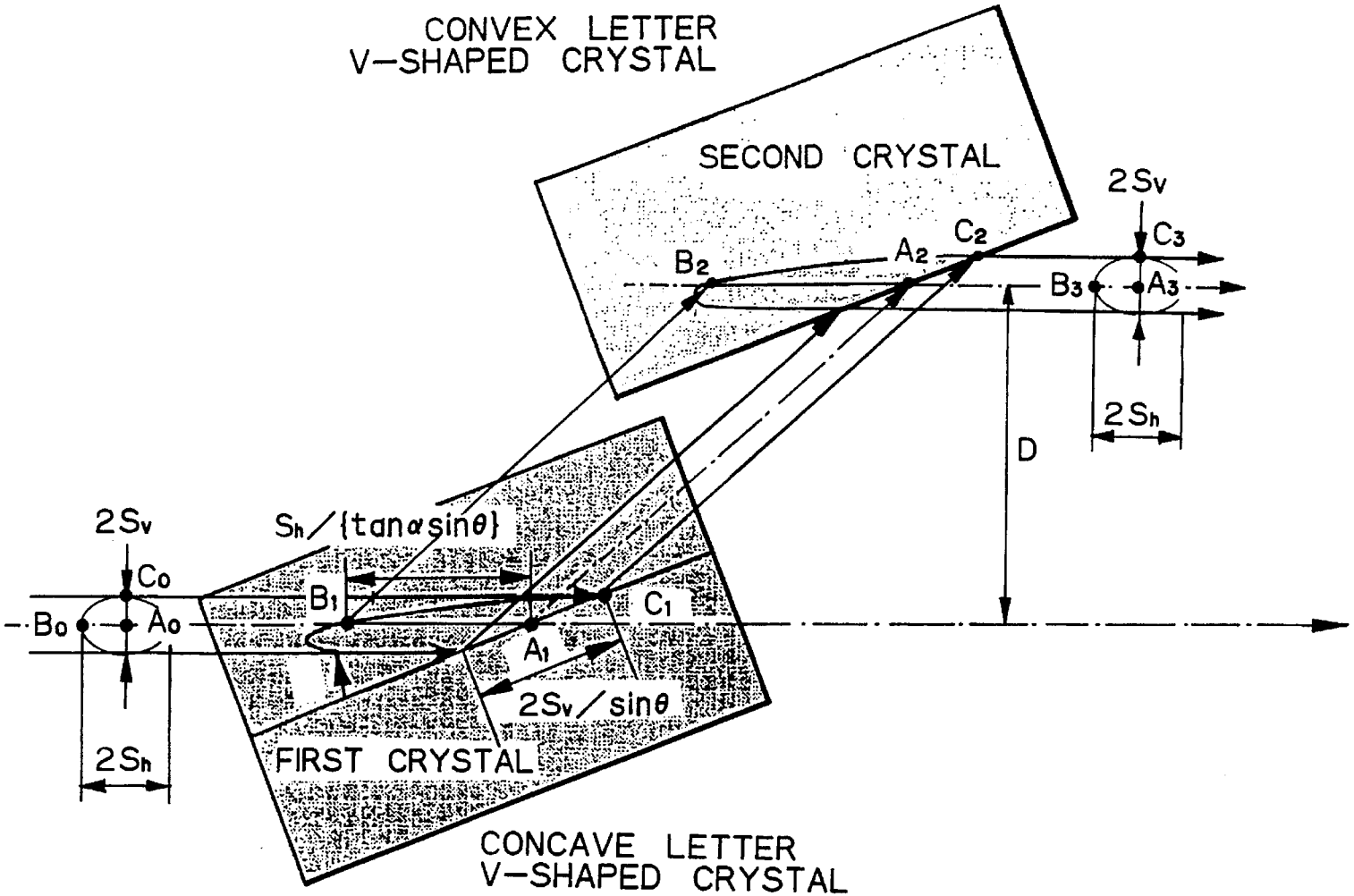
FIG. 7 is a diagram of principle showing a path of a pencil of incident X-rays when a first crystal and a second crystal are arranged in place.
Figure 8:
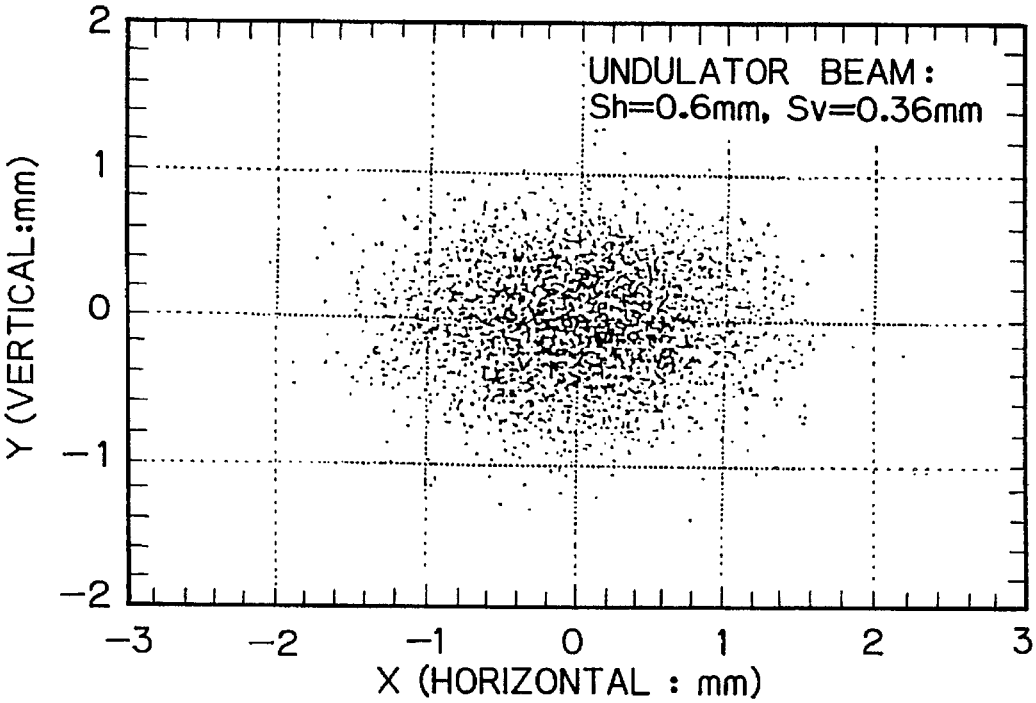
FIG. 8 is a distribution diagram showing a power distribution of a first beam from an undulator.
Figure 9:
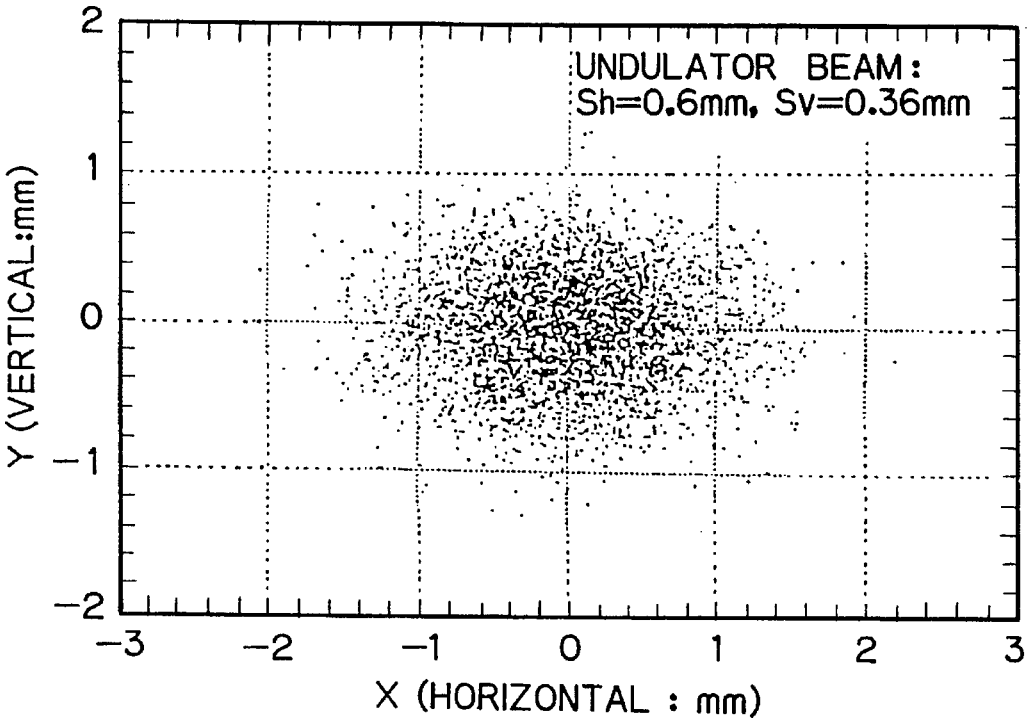
FIG. 9 is a distribution diagram showing a power distribution of an emissive beam which is obtained as a result of the first beam of FIG. 8 having passed the monochromator when the first and second crystals are arranged in place.

FIG. 7 shows a path of a parallel pencil of X-rays which enters the first crystal and then exits the second crystal. A parallel pencil of radiant X-rays enters the first crystal 10 at the first surface of incidence 12 having the concave letter V-shaped groove 11 (angle between the letter V-shaped inclined surfaces: $2\alpha$). The first surface of incidence 12 is inclined at an angle of $\theta$ from a pencil of incident X-rays $A_0B_0C_0$ (minor axis $2S_v$, major axis $2S_h$), and thus the shade $A_1B_1C_1$ of X-rays on the surface of incidence elongates to a half-ellipse (minor axis $2s_v/\sin\theta$, major axis $S_h/\{\tan\alpha \sin\theta\}$. Then, the X-rays which have expanded on the first surface of incidence 12 reflect therefrom. Thus reflected X-rays enter the second crystal 20 at the second surface of incidence 22 having the letter V-shaped convex 21 (angle between the letter V-shaped inclined surfaces: $2\alpha$). The concave letter V-shaped groove 11 and the letter V-shaped convex 21 fit into each other and are positioned so as to align with each other. As a result, the first surface of incidence 12 and the second surface of incidence 22 are arranged in parallel with each other and spaced by D. Accordingly, a pencil of X-rays reflecting from the first surface of incidence 12 impinges in parallel on the second surface of incidence 22, thereby forming a half-elliptical shadow $A_2B_2C_2$ of X-rays having the same size on the second surface of incidence 22. As a result of arranging the first surface of incidence 12 and the second surface of incidence 22 in parallel with each other, a pencil of X-rays impinging on the second surface of incidence 22 exits at the same angle $\theta$ as the Bragg angle $\theta$ to the first surface of incidence 12. Thus, a pencil of emissive X-rays $A_3B_3C_3$ (minor axis $2S_v$, major axis $2S_h$) is obtained which has the same size and parallelism as the initial parallel pencil of X-rays. In this case, a cross section of the pencil of incident X-rays is seen from FIG. 8, and a cross section of the pencil of emissive X-rays is seen from FIG. 9. FIG. 8 is a distribution diagram showing a power distribution of the first beam from an undulator, representing a pencil of incident X-rays which enters the first crystal. FIG. 9 is a distribution diagram showing a power distribution of the emissive beam which exits the monochromator, representing a pencil of emissive X-rays which exits the second crystal. As seen from the figures, both cross sections agree well with each other, indicating that the pencil of emissive X-rays accurately reproduces the pencil of incident X-rays. Since the pencil of emissive X-rays is useful as a light for X-ray structural analysis, material evaluation and the like, it is found that high-accuracy X-ray spectroscopic performance can be obtained.

Figure 10:
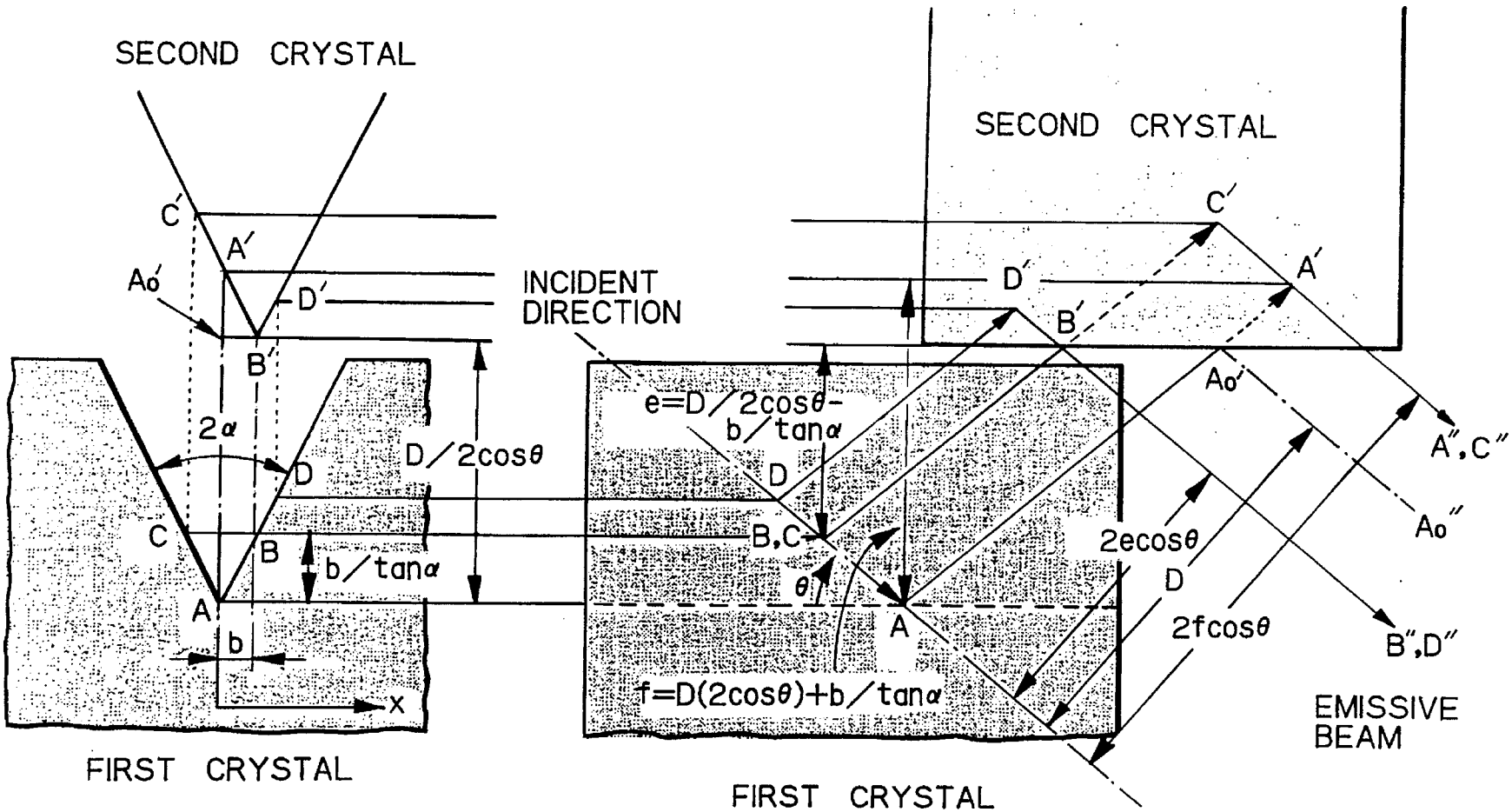
FIG. 10 is a diagram of principle used for calculating the shape of emissive X-rays when the first and second crystals are misset.
Figure 11:
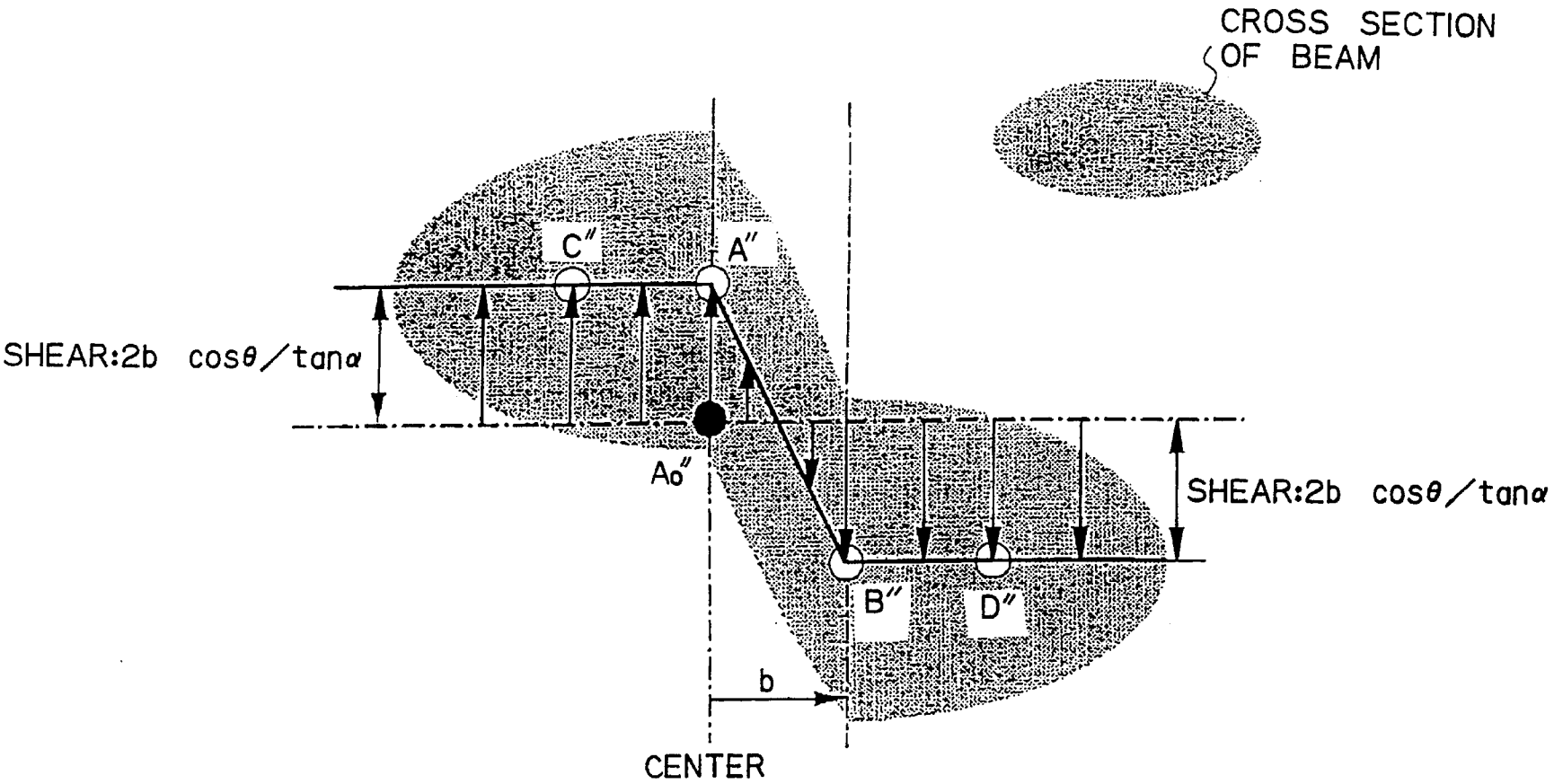
FIG. 11 is a distribution diagram showing an intensity distribution of the cross section of a pencil of emissive X-rays which is obtained from an elliptical pencil of incident X-rays when the first and second crystals are misset by deviation b.
Figure 12:
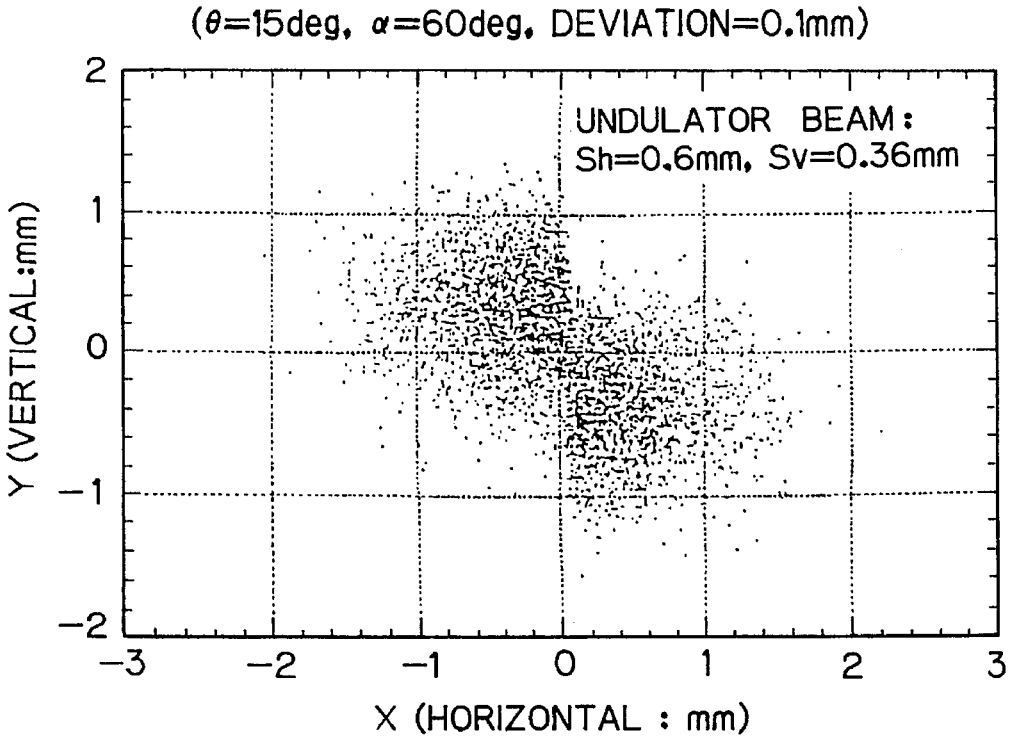
FIG. 12 is a distribution diagram showing a power distribution of an emissive beam which is obtained as a result of the elliptical first beam having passed the monochromator when the first and second crystals are misset by deviation b.
Figure 13:
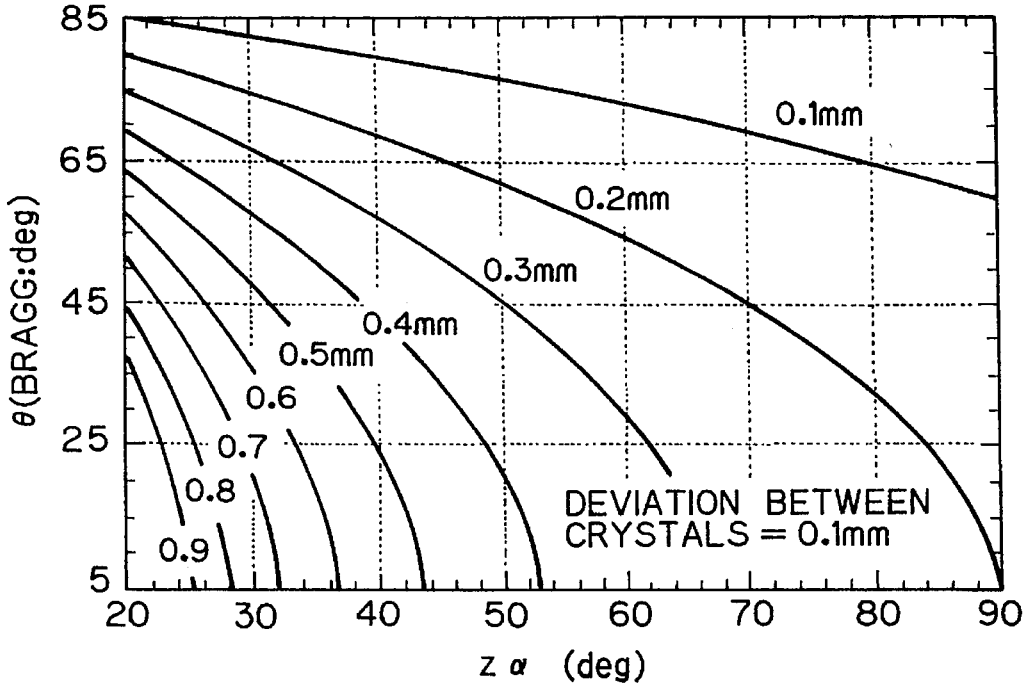
FIG. 13 is a graph showing a magnitude of a shear of the cross section of an emissive beam when the first and second crystals are misset by deviation b.
Figure 14:
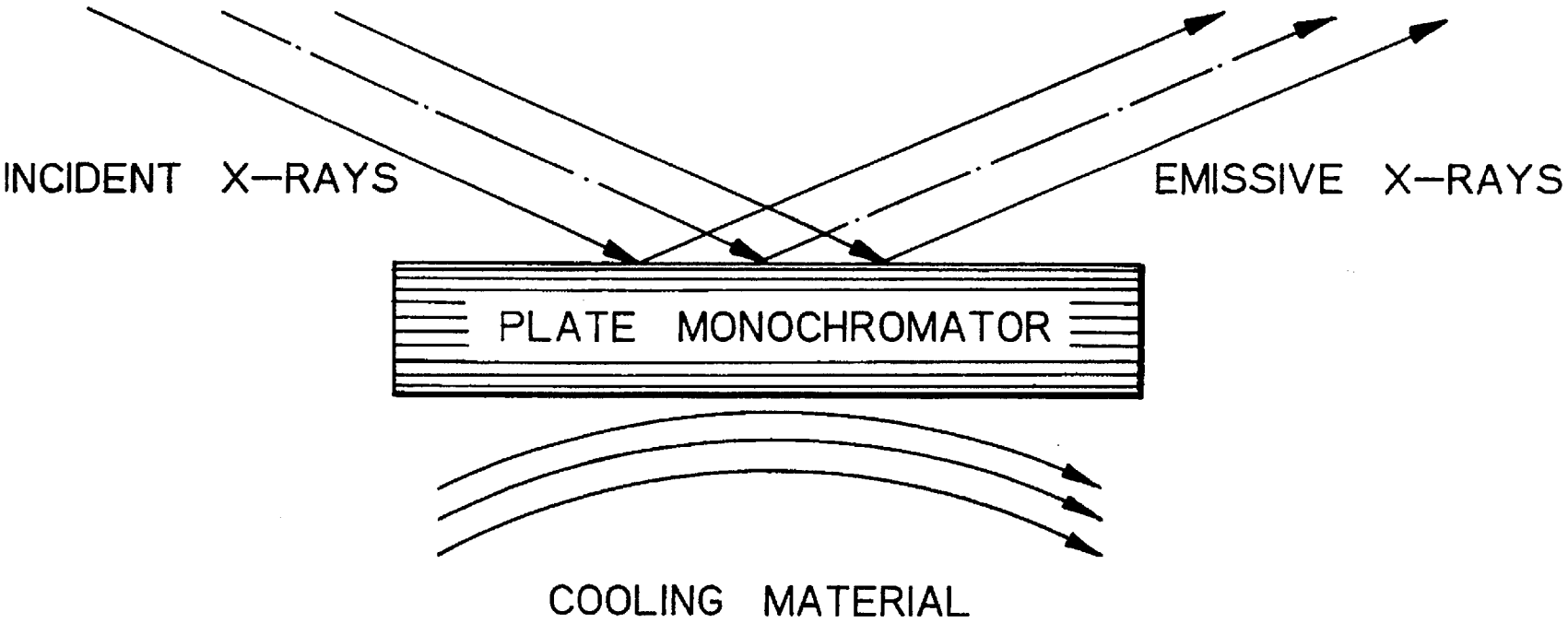
PRIOR ART Fig. 14
FIG. 14 is a diagram of principle showing a cooling method for a conventional plate type monochromator.

To obtain useful light which accurately has the same size and parallelism as a pencil of radiant X-rays, it is preferable that the first crystal 10 and the second crystal 20 be arranged in such a manner that the centerline of the bottom portion 13 of the concave letter V-shaped groove aligns with the centerline of a tip portion 23 of the letter V-shaped convex 21. Suppose that the first crystal 10 and the second crystal 20 deviate from each other by spacing b. In this case, as shown in FIG. 10, X-rays which reflect from the first crystal 10 do not impinge in parallel on the second surface of incidence 22 of the second crystal 20. Unlike an initial parallel pencil of X-rays, resultant emissive X-rays become an unparallel pencil of X-rays, whose cross section is a stepped cross section having a shear of $2b \cos\theta/\tan\alpha$, as shown in FIG. 11. For example, in a test under the conditions in which the angle, $\theta$, (Bragg angle) between a pencil of incident X-rays and a surface of incidence is 15 degrees, an angle of a V groove is $2\alpha$, and the deviation, b, between the first and second crystals is 0.1 mm, the result is that an intensity distribution of a pencil of emissive X-rays, i.e., an intensity distribution of monochromatic light is found to have a stepped cross section as shown in FIG. 12. FIG. 13 is a graph in which a shear of the cross section of an emissive beam is plotted as the Bragg angle, $\theta$, and the angle, $2\alpha$, of the letter V-shaped groove are varied at 0.1 mm in the deviation between the first and second crystals. As seen from FIG. 13, as $\theta$ and $2\alpha$ approach 90 degrees, a shear of the cross section of the emissive beam becomes smaller. In other words, in order to obtain a pencil of emissive X-rays which is substantially equal to a pencil of incident X-rays at high accuracy, the deviation between the first and second crystals can also be compensated by bringing an angle of the letter V-shaped groove closer to 90 degrees.

According to a monochromator for radiant X-rays of the present invention, a heat flux per unit area of incident X-rays can be reduced on the surface of a crystal, and cooling characteristics equivalent to those of a commonly used water cooled or liquid gallium cooled monochromator can be obtained. Also, the structure is such that thermal stresses due to incident X-rays cancel each other out, whereby a thermal deformation can be suppressed. Furthermore, two crystal surfaces of incidence are provided which are in the shape of concave letter V and convex letter V combined, and thus a longitudinal size can be halved as compared with conventional inclined crystal monochromators, thereby attaining a compact structure. Also, this structure is less likely to be subjected to mechanical deformation. Even when any deformation takes place, the deformation can be directed so as not to affect optical performance. In addition, cooling means extends from the bottom portion of a crystal and runs behind the surface of incidence, whereby cooling efficiency can be increased.

Thus, the monochromator for radiant X-rays of the present invention is compact, suppresses a fluctuation in the position of a pencil of incident X-rays, allows easy adjustment, provides a pencil of emissive X-rays stably and highly accurately, is easy to use and economical, and allows easy maintenance.

As has been stated above, having good cooling and excellent distortion characteristics, being compact and easy to use, providing a stable pencil of emissive X-rays at high accuracy, and allowing easy installation, adjustment, and maintenance, the monochromator for radiant X-rays of the present invention fully exhibits capabilities thereof when used in third-generation radiant beam facilities.

From the above description of the invention, those skilled in the art will perceive improvements, changes and modifications. Such improvements, changes and modifications within the skilled of the art are intended to be covered by the appended claims.

What is claimed is:

1. A monochromator for radiant X-rays comprising a first crystal which has a surface of incidence having a concave letter V-shaped groove and cooling means for flowing a cooling material behind the surface of incidence along the letter V-shaped groove, and a second crystal which has a letter V-shaped convex having a convex letter V-shape to fit the concave letter V-shaped groove.

2. A monochromator for radiant X-rays according to claim 1, wherein said first crystal and said second crystal are arranged in such a manner that the bottom portion of the concave letter V-shaped groove and the tip portion of the letter V-shaped convex are positioned on substantially the same line.

3. A monochromator for radiant X-rays according to claim 1, wherein the angle of the letter V in the letter V-shaped groove and the letter V-shaped convex is substantially 90 degrees.

4. A monochromator for radiant X-rays according to claim 1, wherein the cooling means extends from the bottom portion of said first crystal to a portion just under the bottom portion of the concave letter V-shaped groove, branches off from the portion just under the bottom portion in opposite directions, and extends behind a surface of incidence along the concave letter V-shaped groove.

5. A monochromator for radiant X-rays according to claim 1, wherein the cooling means includes a tubular member which is formed of material having pressure and heat resistance.

6. A monochromator for radiant X-rays according to claim 1, wherein the cooling means uses water and/or liquid metal as a cooling material.

7. A monochromator for radiant X-rays according to claim 6, wherein liquid gallium is used as the liquid metal.

8. A monochromator for radiant X-rays according to claim 1, wherein the cooling means provides a water jet.

* * * * *